US006098980A

United States Patent [19]

Ramage et al.

[11] Patent Number: 6,098,980

[45] Date of Patent: Aug. 8, 2000

[54] PUZZLE WITH STORY BOARD

[76] Inventors: Richard A. Ramage; Thomas C. Evans, both of 4094 E. 131st St., Thorton, Colo. 80641

[21] Appl. No.: 09/301,530

[22] Filed: Apr. 28, 1999

Related U.S. Application Data

[63] Continuation of application No. 08/637,151, Apr. 23, 1996, abandoned.

[51] Int. Cl.[7] ..... A63F 9/10

[52] U.S. Cl. ..... 273/157 R

[58] Field of Search ..... 273/153 R, 156, 273/157 R

[56] References Cited

U.S. PATENT DOCUMENTS 1,383,097 7/1921 Gibson .
1,477,322 12/1923 Degheri .
2,693,362 11/1954 Ford .
3,707,287 12/1972 Spector .
4,640,512 2/1987 Burke .
4,838,551 6/1989 Volpert .
5,213,507 5/1993 Ozrovitz .
5,318,306 6/1994 Levin .
5,401,032 3/1995 Barnhart et al. .

*Primary Examiner*—Steven Wong
*Attorney, Agent, or Firm*—Glenn L. Webb

[57] ABSTRACT

The present invention provides a combination puzzle and associated information, such as a story. The present invention includes a story board on which a story or other information is presented. Puzzle pieces are assembled on the story board over the story or other information. Once assembled, the puzzle pieces pictorially depict some aspect relating to the story or other information.

10 Claims, 3 Drawing Sheets

PUZZLE WITH STORY BOARD

RELATED APPLICATIONS

This application is a continuation of Ser. No. 08/637,151 filed on Apr. 23, 1996 now abandoned.

FIELD OF THE INVENTION

This invention relates to the field of puzzles, and particularly to the field of jigsaw puzzles.

BACKGROUND OF THE INVENTION

Puzzles are often used as entertainment devices. For instance, jigsaw puzzles have been used for centuries to entertain and amuse players. Typically, the pieces of a jigsaw puzzle are fitted together to form a pictorial reproduction of a landscape scene or other object. These puzzles are normally used strictly as entertainment devices.

A few puzzles have been created for use as instructional systems as well. For instance, U.S. Pat. No. 4,640,512 discloses an interactive book puzzle instructional entertainment system. This system includes a story book with puzzle pieces. The player is able to fit puzzle pieces together in accordance with the story in the book.

Another puzzle is disclosed in U.S. Pat. No. 5,213,507. This patent discloses an instructional child's story and picture book. A book is used having pages with a story on one side and a puzzle on another page or side of the page. Interlocking pieces are included which when fitted together form an image relating to the story on the opposing page. The puzzle may include a cavity for fitting the puzzle pieces together. The bottom surface of this cavity may include some prints or words to assist the player in placing the pieces in the cavity for less advanced players.

The known prior art puzzles seldom use a backing layer on which the pieces of a puzzle are fitted together. The only known use of a backing layer on which text or prints are used is disclosed in U.S. Pat. No. 5,213,507. This use is only to assist small children or less skilled players in placing the pieces together on the backing layer. The only known uses of using a puzzle to depict a story, as described above, use a puzzle in a physically separate location than the story itself. There are no presently known puzzles which incorporate a story into the backing layer of the puzzle itself.

SUMMARY OF THE INVENTION

The present invention provides an entertaining and useful puzzle. The puzzle is associated with a story or other information which is pictorially depicted by the assembled puzzle pieces. The present invention uniquely provides the story on a story board. The puzzle pieces are then assembled directly over the story on the story board.

The puzzle of the present invention includes a story board. In the preferred embodiment, the story board has a raised border around the edges of the front side This border creates a recessed portion on the story board. A story or other information is formed on this recessed portion of the story board. This story or information can include text, graphics or combinations of the two. Puzzle pieces, such as jigsaw puzzle pieces are assembled within this recessed portion. Once assembled, the puzzle pieces pictorially depict some aspect relating to the story or information. Thus, the player or assembler of the puzzle not only is entertained by the assembly of the puzzle pieces, but also is entertained, informed, educated and/or inspired by the underlying information on the story board and the connection of the puzzle and information.

The present invention has widespread application in many areas. For instance, the story board could include short stories, poetry, nurserty rhymes and inspirational messages. The assembled puzzle pieces would depict some aspect of the story on the story board. Also, the puzzle of the present invention could include a series of such stories and puzzles to form a more complete story. The story board could include clues, hints or riddles with the assembled puzzle pieces providing the solution or additional clues.

Other applications include putting information, such as an athletes statistics on the story board. The assembled puzzle pieces would then depict the athlete. An entire team roster could be depicted on the story board with the team photograph forming the puzzle.

The present invention includes many other variations and applications. These aspects of the present invention are described in greater detail in the detailed description of a preferred embodiment and in the drawings.

DETAILED DESCRIPTION OF A PREFERRED EMBODIMENT

The present invention provides a jigsaw puzzle combined with a story. It is to be expressly understood that the detailed description provided herein is for explanatory purposes only and is not intended to limit the scope of the inventive concept. Other embodiments and variations are considered to be within the scope of the invention as claimed.

Figure 1:
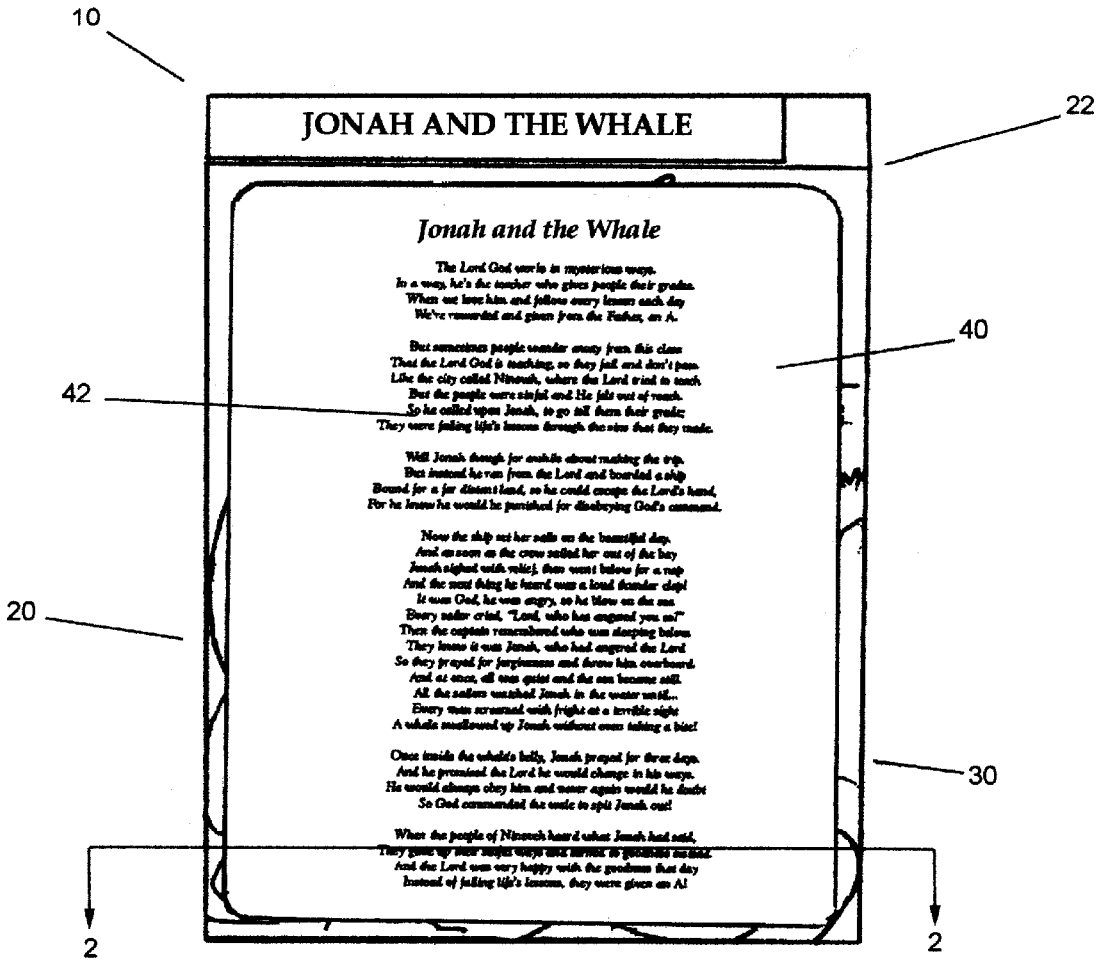
FIG. 1 illustrates a preferred embodiment of the story board of the present invention with the puzzle pieces disassembled.
Figure 2:
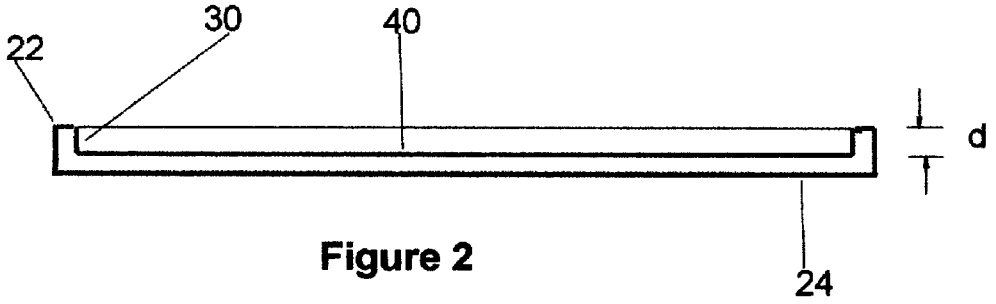
FIG. 2 illustrates a cross-section of the embodiment of FIG. 1 along lines 2—2.

One preferred embodiment of the present invention is illustrated in FIGS. 1–4. Puzzle 10 includes story board 20 and puzzle pieces 100. Story board 20, as shown in FIGS. 1 and 2 includes front side 22 and rear side 24. Raised border 30 having width "d" is formed around the edges of front side 22 of story board 20. Width "d" can be of any chosen dimension but in the preferred embodiment is about five percent of the total width of puzzle 10. Border 30 forms a frame on front side 22 of story board 20 to create recessed portion 40 on story board 20.

Figure 3:
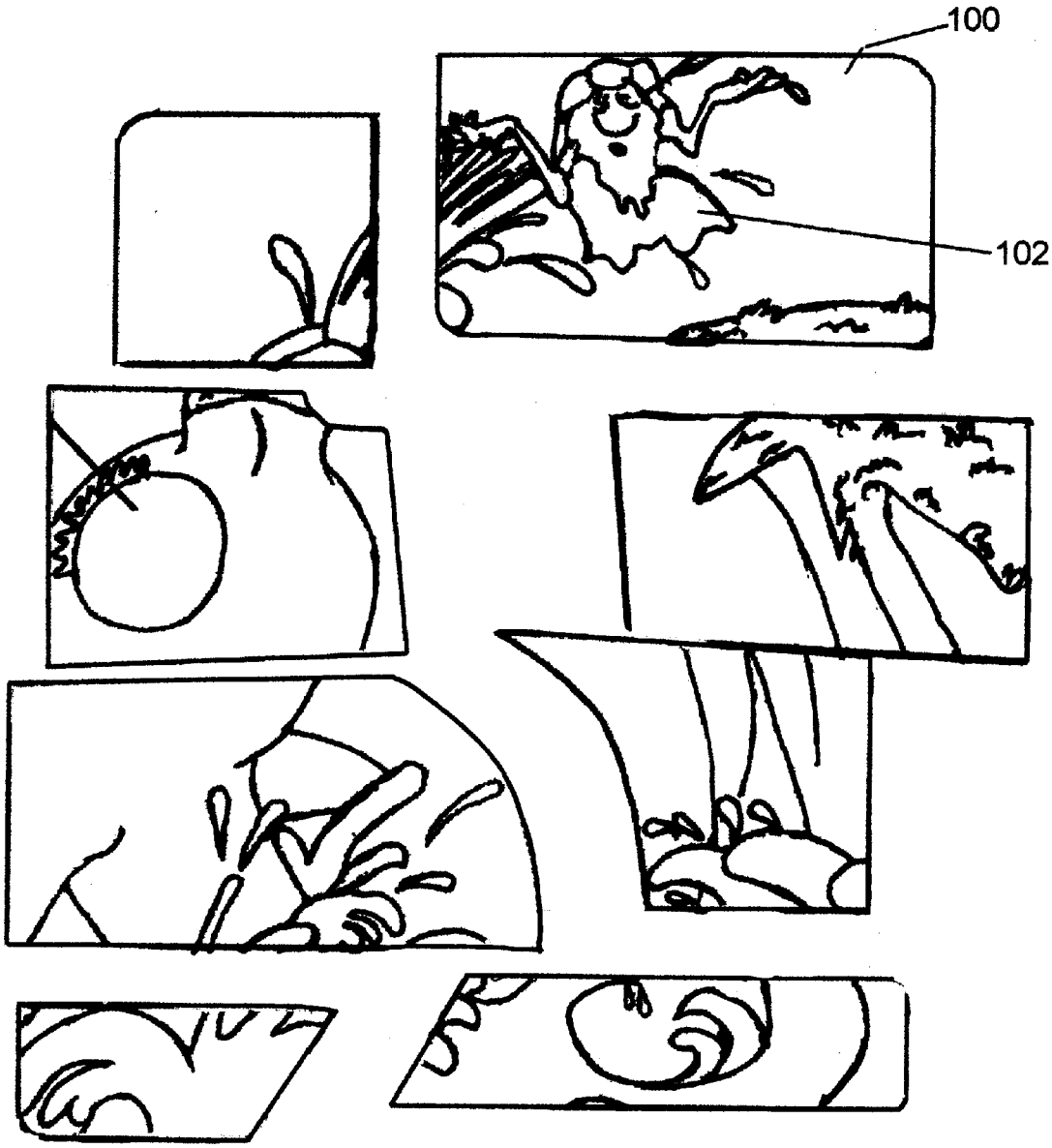
FIG. 3 illustrates the disassembled puzzle pieces.
Figure 4:
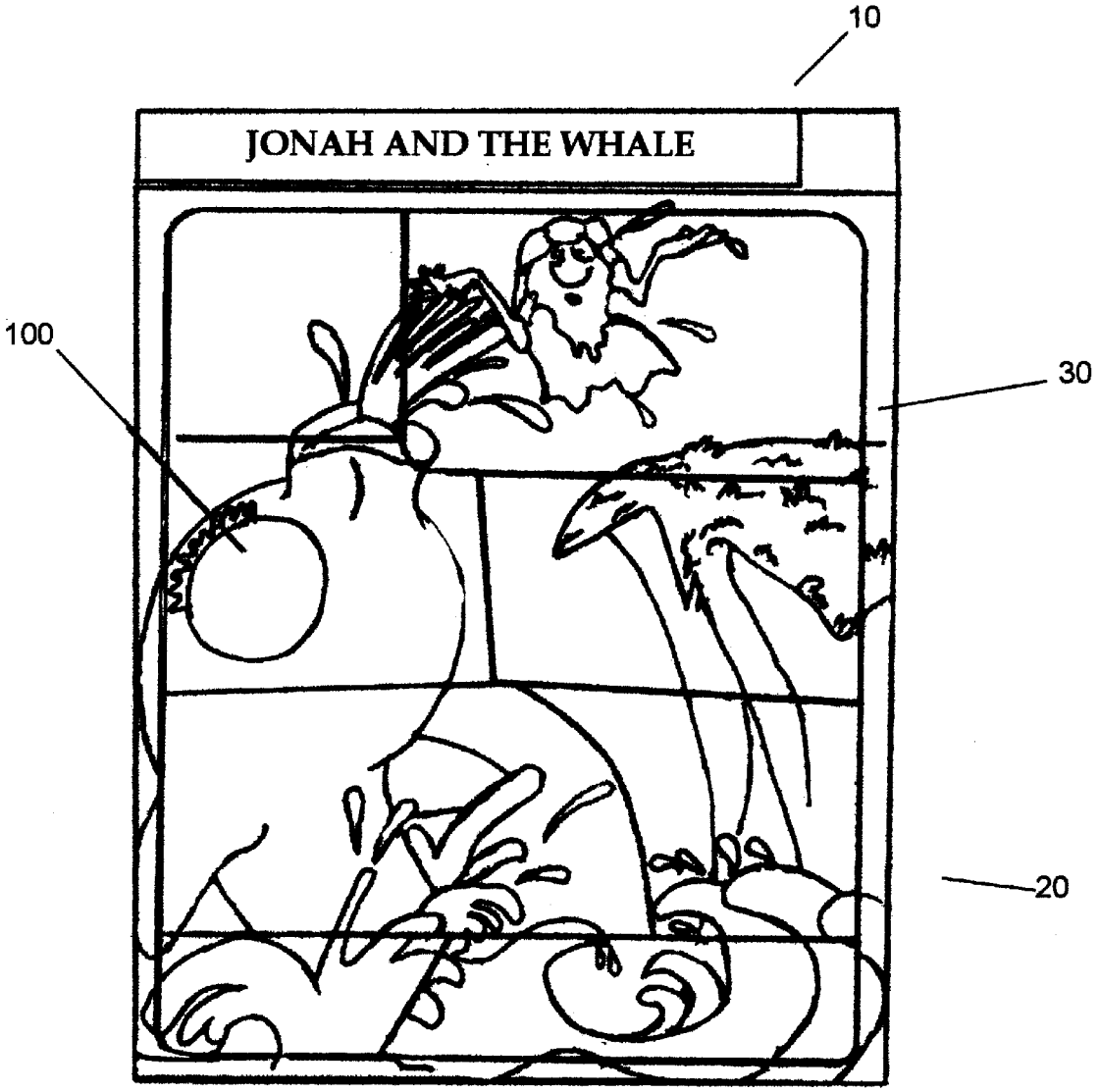
FIG. 4 illustrates the assembled puzzle on the story board.

A story 42 is formed in recessed portion 40 of story board 20. This story can be text or graphics or a combination of both. The story can be of an inspirational, educational, informative or entertaining nature. Puzzle pieces 100, shown in FIG. 3, are configured to be assembled within recessed portion 40. Once properly assembled, as shown in FIG. 4, puzzle pieces 100 form a pictorial or graphical representation of the story that was created within recessed portion 40. This representation can be directly representative of the moral or point of the story, of the main character, of the main point of action or other high points of the story. A series of these puzzles could be produced as well to present an entire story.

The person utilizing this product is thus entertained or informed doubly by this invention. The story and pictorial representation can be designed not only to inspire or amuse the person, but can also be used to increase the cognitive skills of the person. The puzzle not only increases the dexterity and cognitive skills of the person by assembling the puzzle, but also the interaction between the story and the pictorial representation of the puzzle can be used to increase these cognitive skills.

The puzzle and story can be created at different levels of interest of the story and skill of assembly of the puzzle pieces. For instance, a story at the nursery rhyme level could be used with large simple puzzle pieces for small children. A more advanced story could be created with more difficult puzzle pieces for more advanced players.

Other applications for the present invention include the use of a mystery story having clues. One or more clues could be included on story board 20. The solution to the mystery is provided by the assembly of puzzle pieces 100. A plurality of these puzzles could be created with each single puzzle providing clues. For instance, the story board could provide a hint, riddle or clue with the assembled puzzle pieces forming another hint or clue. A series of these puzzles could be created to tell a complete story or solve a mystery.

The story board could also utilize humor. The story would be a joke, riddle or humorous anecdote. The assembled puzzle pieces would present the punch line of the story.

Another application for the present invention is for commercial advertisement. The story on story board 40 includes a commercial advertisement for an establishment, such as a restaurant. The assembled puzzle pieces could create another advertisement or a prize from the establishment. This particular application could be formed from relatively inexpensive and non-durable paper stock since it would essentially be a "throw-away" promotional piece.

The story board could also be used to provide statistics on a professional athlete, similar to a baseball card. The assembled puzzle pieces would show the athlete in action. Another application is to list the player roster of an athletic team. The assembled puzzle pieces would then show the team photograph.

Also, the story board could include the school song of a university. The assembled puzzle pieces would then show the school logo or mascot. Other applications could include popular movies or television programming. The story could relate to stories, characters or action themes of the movie or s television programming. The assembled puzzle pieces would depict characters on the movie or television programming. Similarly, the story could represent the lyrics to popular music. The assembled puzzle pieces would depict the musical act performing the lyrics.

The present invention could be used in an educational nature as well. Educational or inspirational facts could be presented on the story board. The assembled puzzle pieces would then depict the event being described.

The present invention has many other applications beyond these presently set forth in the descriptive embodiment. Essentially, the present invention provides a combination of a graphical or informative representation in the form of a puzzle relating to information formed on the story board of the puzzle. These descriptive embodiments are not mean to limit the scope of the present inventive concepts. The present invention provides a useful and entertaining product which has not previously been available publicly.

We claim:

1. A puzzle connected with a story, said puzzle comprising:

a story board having a front side and an opposing back side;

a puzzle assembly area formed on a portion on said front side;

a story printed within said puzzle assembly area providing information prior to assembly of the puzzle; and multiple puzzle pieces forming a pictorial representation of said story when assembled in said puzzle assembly area and covering said story printed within said puzzle assembly area on said story board.

2. The puzzle of claim 1 wherein said backing layer includes:

a raised border along the sides of said front side of said story board forming a frame around said story.

3. The puzzle of claim 2 wherein said puzzle pieces fit within said raised border.

4. The puzzle of claim 1 wherein said story includes:

text describing a story.

5. The puzzle of claim 1 wherein said story includes:

pictorial representation of a story.

6. The puzzle of claim 1 wherein said story includes:

information on an entity; and said puzzle pieces when assembled form a pictorial representation of said entity.

7. The puzzle of claim 6 wherein said information on an entity includes:

statistical information on said entity.

8. The puzzle of claim 1 wherein said puzzle further comprises:

a system of puzzles and stories regarding a complete story.

9. The puzzle of claim 1 wherein said story includes:

a commercial advertisement; and said puzzle pieces when assembled depict a promotional prize regarding said commercial advertisement.

10. The puzzle of claim 1 wherein said story includes:

lyrics to an academic institution; and said puzzle pieces when assembled depict the logo of said academic institution.

* * * * *